US005445513A

United States Patent [19]

Siggers

[11] Patent Number: 5,445,513

[45] Date of Patent: Aug. 29, 1995

[54] APPARATUS FOR ENHANCING CONCENTRATION

[75] Inventor: David L. Siggers, Camden, Ark.

[73] Assignee: Hitech Holding, Inc., East Camden, Ark.

[21] Appl. No.: 179,333

[22] Filed: Jan. 10, 1994

[51] Int. Cl.[6] ..... B28B 1/20; B01F 9/12

[52] U.S. Cl. ..... 425/200; 264/311; 366/213; 366/232; 425/434

[58] Field of Search ..... 425/435, 200, 67, 269, 425/434, 186; 366/213, 232, 217; 264/311

[56] References Cited

U.S. PATENT DOCUMENTS

| | | | |
|---|---|---|---|
| 679,665 | 7/1901 | Ceipek . | |
| 1,336,539 | 4/1920 | Ruby | 425/200 |
| 1,413,332 | 4/1922 | Hooper | 4/67 |
| 1,500,932 | 7/1924 | Hooper | 4/4 |
| 1,500,934 | 7/1924 | Hooper | 4/4 |
| 2,195,429 | 4/1940 | Shaler . | |
| 2,378,042 | 6/1945 | Sorensen et al. . | |
| 3,354,010 | 11/1967 | Hopper et al. . | |
| 3,393,986 | 7/1968 | Firnhaber | 4/200 |
| 3,494,600 | 2/1970 | Kraus | 4/4 |
| 3,785,889 | 1/1974 | Vaganay et al. . | |
| 4,119,304 | 10/1978 | Groom | 10/41 |
| 4,240,777 | 12/1980 | Hallerback et al. | 4/4 |
| 4,393,014 | 7/1983 | Ziegler . | |
| 4,566,919 | 1/1986 | Jessop . | |
| 4,651,618 | 3/1987 | Ringel et al. . | |
| 4,817,685 | 4/1989 | Sherchock et al. . | |
| 4,870,884 | 10/1989 | Schubart et al. . | |
| 5,069,133 | 12/1991 | Canterberry et al. . | |

*Primary Examiner*—Khanh P. Nguyen
*Attorney, Agent, or Firm*—Frijouf, Rust & Pyle

[57] ABSTRACT

An apparatus is disclosed for enhancing the concentration of a second material within a first material, by liquefying the first material and introducing the second material within the first material. The first and second materials are introduced into a container and the container is rotated to generate a centrifugal force for facilitating the migration of the second material through the first material to enhance the concentration of the second material within the first material.

11 Claims, 4 Drawing Sheets

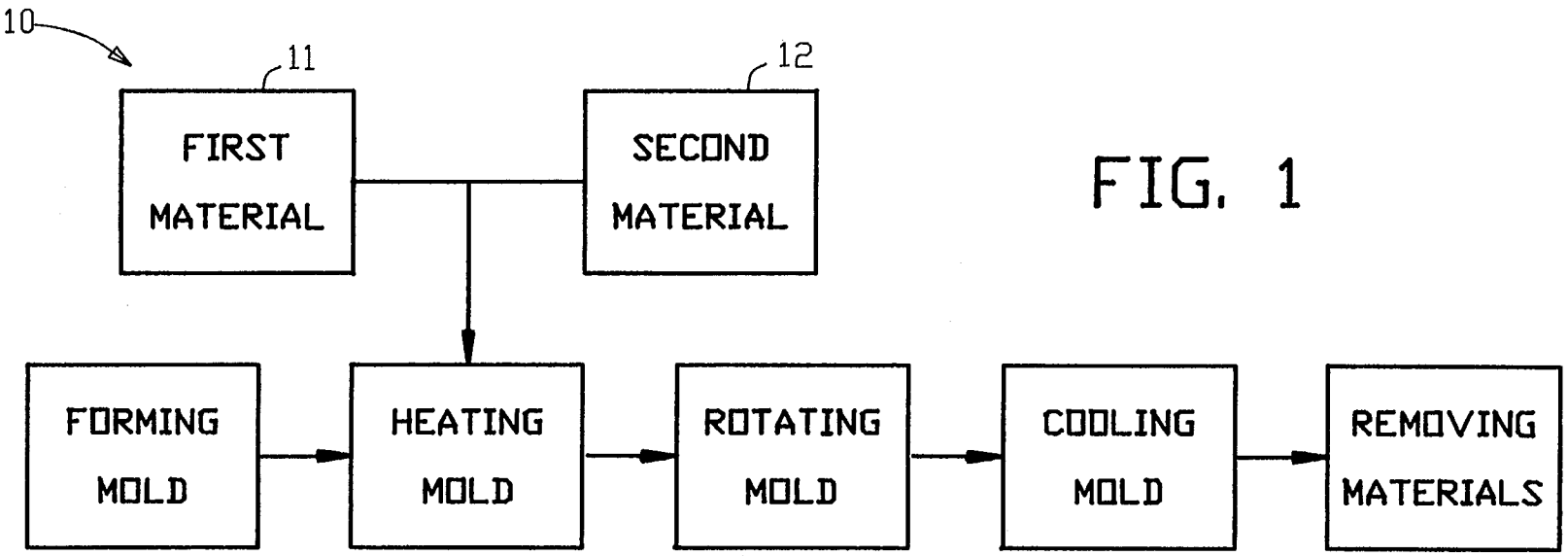
FIG. 1
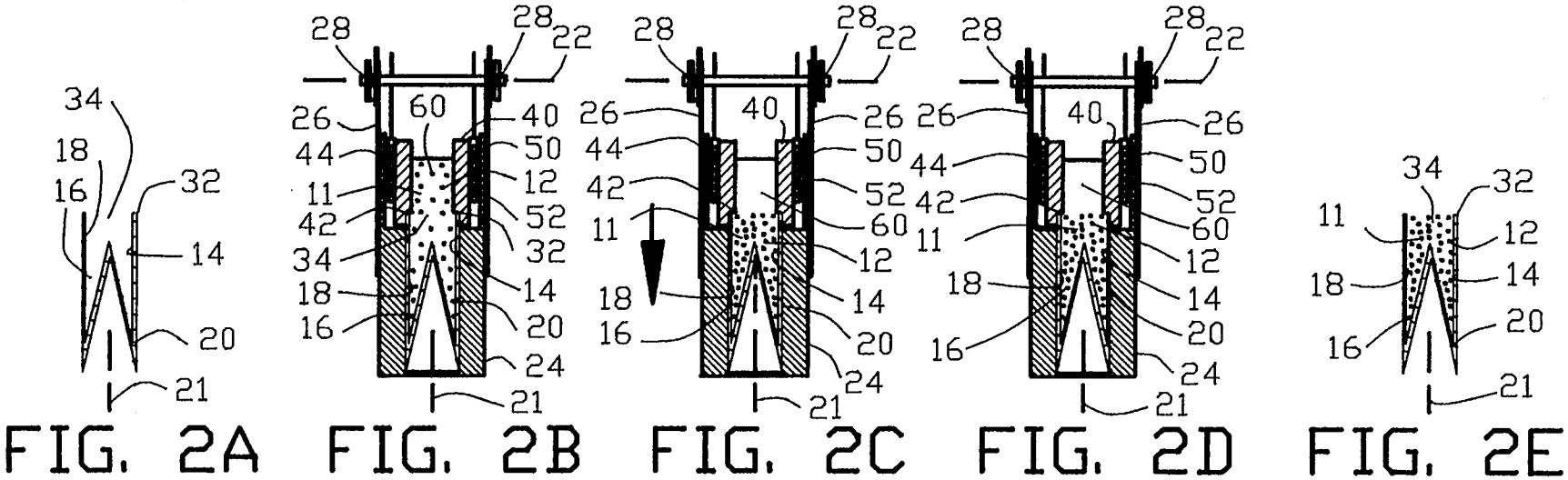

APPARATUS FOR ENHANCING CONCENTRATION

BACKGROUND OF THE INVENTION

1. Field of the Invention

This invention relates to the enhancement of a concentration of a second material into a first material and more particularly to a method and an apparatus for enhancing the concentration of a second material into a first material by a centrifugal process and apparatus.

2. Background of the Invention

In many cases, it is desirable to enhance the concentration of a second material within a first material to provide improved performance of the material due to the enhanced concentration of the second material. In one example of enhancing the concentration of a second material within a first material, the first material is a liquid material and the second material is a solid particulate material. Typically, the second solid particulate material is held in suspension within the first liquid material.

When the first and second material are placed into a container, the second solid particulate material will settle to the bottom of the container by action of gravity. The time required for the second solid particulate material to settle to the bottom of the container is determined by the mass of the second solid particulate material as well as the viscosity of the first liquid material. In many cases, an extended period of time is required for the second solid particulate material to settle to the bottom of the container. An extended period of time for the settling of second solid particulate material may be unacceptable when the first material must be heated to maintain the first material in a liquid state. In some cases, the heating of the first material for an extended period of time may cause degradation or instability of the first material.

Some in the prior art have used a centrifuge for reducing the period of time required for the second solid particulate material to settle to the bottom of the container of a first liquid material. Centrifuges have been used in the prior art for reducing the period of time required for a solid precipitate to settle to the bottom of the container of a liquid material after a chemical reaction.

Others in the prior art have a utilized centrifugal type process for facilitating a molding process. In a centrifugal molding process, a centrifuge was used to enhance the flow of a molding material into a mold cavity.

U.S. Pat. No. 679,665 to Ceipek discloses an apparatus for packing pulverulent granular substances or a substance sufficiently fluid to be influenced by centrifugal action into suitable tubes, pockets or shells.

U.S. Pat. No. 2,195,429 to Shaler discloses a method of loading an explosive into a container.

U.S. Pat. No. 2,378,042 to Sorensen et al discloses a casting machine in which a plurality of different objects may be cast simultaneously by the application of centrifugal forces.

U.S. Pat. No. 3,354,010 to Hopper et al discloses a method for the preparation of a self-supporting high power, flexible sheet explosive of low impact sensitivity.

U.S. Pat. No. 3,785,889 to Vaganay et al discloses a fusible explosive composition comprises 40–90% by weight of a crystalline explosive with a high detonation velocity and 60–10% by weight of 2,4,6-trinitrotoluene.

U.S. Pat. No. 4,393,014 to Ziegler discloses a high solid content explosive charge formed by placing dry solids such as RDX in a mold cavity, adding TNT over the dry solids and holding the interior of the mold cavity at an elevated temperature and reduced pressure to permit diffusion of the liquid TNT through the solids while the vacuum enhances the discharge of air from the mass.

U.S. Pat. No. 4,566,919 to Jessop discloses a cast explosive composition having a relatively high density and energy and a critical diameter no larger than about 150 mm at a temperature of 5° C.

U.S. Pat. No. 4,651,618 to Ringel et al discloses a process for the introduction of a charge into a projectile casing in which the charge is initially rough-pressed or compacted externally of the projectile casing and thereafter inserted into the projectile casing and subsequently finish-compacted.

U.S. Pat. No. 4,817,685 to Skerchock et al discloses an apparatus and method for stirring an explosive material mixture maintained in a molten state to ensure homogeneity of composition and for simultaneous transfer of predetermined quantities by a plurality of positive displacement piston-cylinder mechanisms.

U.S. Pat. No. 4,870,884 to Schubart et al discloses an incendiary projectile possessing an incendiary composition arranged about the internal casing surface of the projectile wall structure. The projectile has the inner casing surface of a wall structure covered with the incendiary composition in fixed adherence therewith, and the explosive in the inner space of the projectile extends into grid-structured interspaces of scorings for the mutual bounding of covered regions.

U.S. Pat. No. 5,069,133 to Canterberry et al discloses a process for producing an encased propellant which comprises overwrapping at least one charge of propellant with an elastomeric coating composition to produce the desired encased propellant. The process is suitably effected by molding, casting, dipping, or otherwise applying the coating composition to the charge of propellant. The process and composition of the present invention is expected to be useful in the production of encased tank ammunition and the like.

Although the aforementioned patents have made contribution to the art, there is a need for a simple and efficient method and apparatus for enhancing the concentration of a second material within a first material.

Therefore, it is an object of the present invention to provide an improved method and apparatus for enhancing the concentration of a second material within a first material utilizing a centrifugal force for facilitating the migration of the second material through the first material.

Another object of this invention is to provide an improved method and apparatus for enhancing the concentration of a second material within a first material that is suitable for use with a liquid first material and solid particulate second material.

Another object of this invention is to provide an improved method and apparatus for enhancing the concentration of a second material within a first material that is suitable for a first material that must be heated to transfer into a liquid state.

Another object of this invention is to provide an improved method and apparatus for enhancing the concentration of a second material within a first material that is suitable for molding the first material with the enhanced concentration of the second material therein in a preselected geometric shape within an interior of the container.

Another object of this invention is to provide an improved method and apparatus for enhancing the concentration of a second material within a first material wherein the first and second materials may be readily introduced into the container.

Another object of this invention is to provide an improved method and apparatus for enhancing the concentration of a second material within a first material that is suitable for use with hazardous first and second materials.

Another object of this invention is to provide an improved method and apparatus for enhancing the concentration of a second material within a first material that heats and cools the first and second materials within a container during the rotation process.

Another object of this invention is to provide an improved method and apparatus for enhancing the concentration of a second material within a first material capable of forming the first and second materials into a final molded part.

Another object of this invention is to provide an improved method and apparatus for enhancing the concentration of a second material within a first material wherein the container may be readily inserted and removed for changing the preselected geometric shape within the interior of the container.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the derailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved method of enhancing the concentration of a second material within a first material, comprising the steps of liquefying the first material and introducing the second material within the first material. The method includes rotating a container on a rotatable member with the first and second materials being disposed within the container to generate a centrifugal force for facilitating the migration of the second material through the first material to enhance the concentration of the second material within the first material. The disclosed method is suitable for use with the second material being a solid particulate material.

In a more specific embodiment of the method, the method includes the first material being liquified and is heated within the container during an initial period of rotation of the rotatable member to maintain the first material in a liquid state for enhancing the migration of the second material through the first material.

The first material with the enhanced concentration of the second material therein may be solidified by cooling the container during a final period of rotation of the rotatable member to solidify the first material with the enhanced concentration of the second material within the container. Preferably, a mold cavity having a preselected geometric shape is formed within an interior of the container and the first material with the enhanced concentration of the second material are solidified within the container to form the first material into the preselected geometric shape. After termination of rotation of the container the first material with the enhanced concentration of the second material is solidified in the preselected geometric shape of container.

The invention is also incorporated into an apparatus for enhancing the concentration of a second material within a first liquid material, comprising a base for rotatably mounting a rotation member shaft. A rotatable member having a central region and a peripheral region with the central region secured to the rotational member shaft for rotation therewith. A container is secured to the peripheral region of the rotational member with the container receiving a liquefied first material and the second material within the container. Means rotate the rotatable member shaft to generate a centrifugal force for facilitating the migration of the second material through the first material to enhance the concentration of the second material within the first material.

In a more specific embodiment of the apparatus, the rotational member shaft extends external to the container. In one embodiment of the invention, the container is secured to the peripheral region of the rotational member by a pivot for pivotably mounting the container to the rotatable member. The pivot has a pivot axis aligned generally perpendicular to the rotational member shaft for enabling the centrifugal force to pivot the container along the pivot axis upon rotation of the rotatable member. In this embodiment of the apparatus, the rotatable member shaft is disposed in a substantially vertical orientation.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which:

FIG. 1 is a block diagram illustrating the method of enhancing the concentration of a second material within a first material with the present invention;

FIG. 2A is a side sectional view of a mold cavity formed by the method of FIG. 1;

FIG. 2B is a side sectional view of the mold cavity formed by the method of FIG. 1 being heated with the first and second materials therein;

FIG. 2C is a side sectional view of the mold cavity formed by the method of FIG. 1 illustrating a centrifugal force being applied to the first and second materials therein;

FIG. 2D is a side sectional view of the mold cavity formed by the method of FIG. 1 being cooled with the first and second materials therein;

FIG. 2E is a side sectional view of the mold cavity formed by the method of FIG. 1 including the first material with the enhanced concentration of the second material formed in a preferred geometric shape;

Similar reference characters refer to similar parts throughout the several Figures of the drawings.

DETAILED DISCUSSION

Figure 3:
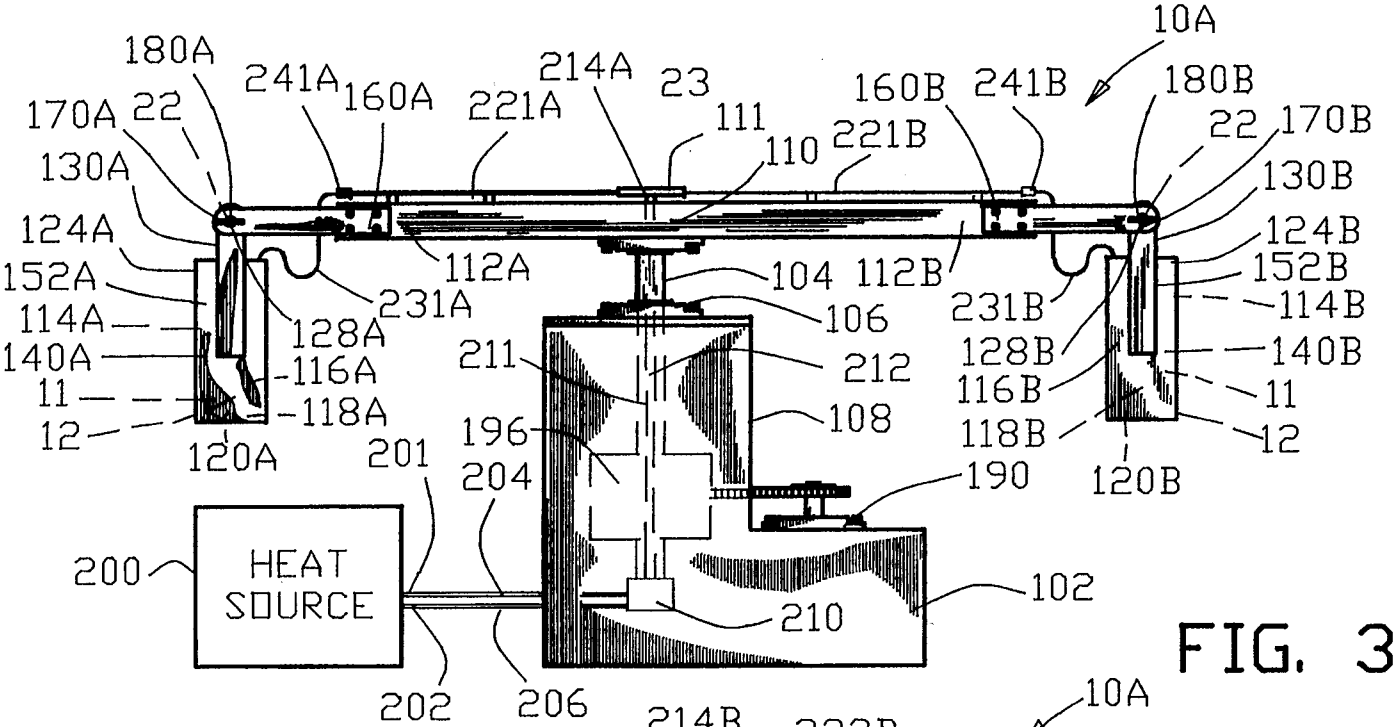
FIG. 3 is a side elevational view of an apparatus for enhancing the concentration of a second material within a first material utilizing the method of the present invention with the apparatus being shown in a static condition.

FIG. 1 is a block diagram illustrating the process 10 of enhancing the concentration of a first material 11 with a second material 12 through the use of the present invention. Preferably, the first material 11 is a solid material having a first melting point at which the first material 11 exists in a liquefied state. Preferably, the second material 12 is a solid particulate material. In the alternative, the second material 12 may be a solid material having a second melting point commensurate with the first melting point at which the second material 12 exists in a liquefied state.

FIG. 1 illustrates the process of forming a mold cavity having a preselected geometric shape. FIG. 2A is a side sectional view of a mold cavity 14 suitable for use with the present invention formed by the method of FIG. 1. The mold cavity 14 has a preselected geometric shape 16 defined within an interior 18 of a container 20.

FIG. 2B is a side sectional view with the first and second materials 11 and 12 being disposed within the mold cavity 14 and with the container 20 being secured within an apparatus 10A. The mold cavity 14 extends along a first axis 21 through an axis of symmetry of the container 20. The container 20 is pivotable upon a second axis 22 when the container 20 is placed within a container carrier 24. The container carrier 24 has carrier arms 26 defining pivot apertures 28 for defining a second axis 22 extending external to the container 20 and being disposed substantially perpendicular to the first axis 21. The container 20 is shown disposed in a static position with the first axis 21 orientated in a substantially vertical position as shown in FIGS. 2A–2E for receiving the first and second material 11 and 12 within the mold cavity 14.

The container 20 includes a rim 32 defining an opening 34 for receiving the first and second materials 11 and 12 therein. Preferably, a riser 40 is located on the container 20 for facilitating the introduction and enhancement of the concentration of the second material 12 within the first material 11. The riser 40 defines a shoulder 42 for receiving the rim 32 of the container 20 to form a liquid tight seal therebetween. The riser 40 includes a cylindrical sidewall 44 with heating means 50 shown as heating coils 52. As will be described in greater detail hereinafter, the heating coils 52 apply heat to the riser 40 to elevated the temperature of the first material 11 above the first melting point.

FIG. 1 illustrates the process of heating the mold cavity 14 with the first and second materials 11 and 12 being disposed within the mold cavity 14 as shown in FIG. 2B. Preferably, the first material 11 is heated by conventional means (not shown) such as a conventional oven or the like. After liquefying the first material 11, the second material 12 is introduced into and mixed with the first material 11 to form a suspension of the second material 12 within the first material 11. The heated and mixed first and second materials 11 and 12 are introduced into the heated mold cavity 14 of the container 20 through the riser 40. The first and second materials 11 and 12 are introduced into the riser 40 to substantially fill the riser 40. In the alternative, the first material 11 may be introduced into the mold cavity 14 in a solidified state with the heating coils 52 within the riser 40 liquefying the first material 11. After the liquification of the first material 11, the second material 12 may be introduced within the first material 11.

FIG. 1 illustrates the process of rotating the mold cavity 14 with the first and second materials 11 and 12 therein to generate a centrifugal force as shown by the arrow in FIG. 2C. The centrifugal force facilitates the migration of the second material 12 through the first material 11 to enhance the concentration of the second material 12 within the first material 11. As will be described in greater detail hereinafter, the container 20 is rotated about a third axis 23 external to the container 20 for generating the centrifugal force to enhance the migration of the second material 12 through the first material 11. The rotation of the container 20 about the third axis 23 external to the container 20 generates the centrifugal force to cause the migration of the second material 12 through the first material 11. The first and second materials 11 and 12 within the mold cavity 14 is greatly enhanced with the concentration of the second material 12 relative to the solidified first and second materials 11 and 12 within an external portion 60 solidified within the riser 40. Preferably, the container 20 is heated by the heating coils 52 during an initial period of rotation of the container 20 to maintain the first material 11 in a liquid state for enhancing the migration of the second material 12 through the first material 11.

FIG. 1 illustrates the step of cooling the mold cavity 14 of the container 20 to solidify the first material 11 with the enhanced concentration of the second material 12 within the mold cavity 14 of the container 20 as further shown in FIG. 2D. Upon completion of the concentration process of the second material 12 within the first material 11, the heat directed to the heating coils 52 is terminated for enabling the cooling of the first and second materials 11 and 12 within the mold cavity 14 of the container 20. During a final period of rotation of the container 20, the cooling of the container 20 solidifies the first material 11 with the enhanced concentration of the second material 12 therein into the preselected geometric shape 16 of the mold cavity 14 of the container 20.

FIG. 1 illustrates the step of terminating rotation of the container 20 and the removing of the first material 11 and the enhanced concentration of the second material 12 solidified in a preselected geometric shape 16 as shown in FIG. 2E. The riser 40 is removed from the container 20 and the external portion 60 of the first and second materials 11 and 12 previously solidified within the riser 40 may be removed by conventional means such as sawing or the like.

The present process provides the first material 11 formed in the preselected geometric shape 16 with an enhanced concentration of the second material 12. In some circumstances, the solidified first and second materials 11 and 12 may be removed from the mold cavity 14 of the container 20.

Figure 4:
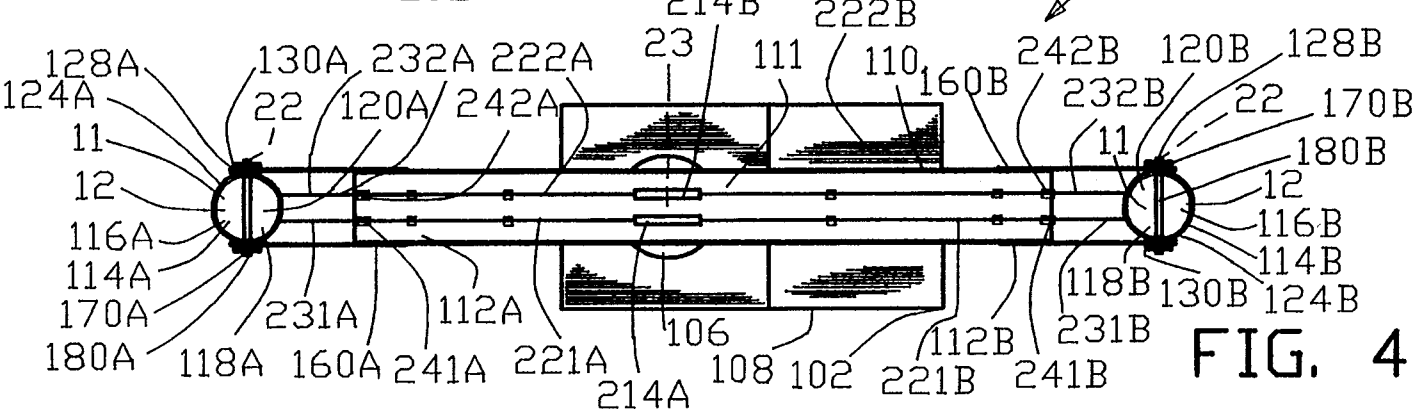
FIG. 4 is a top view of FIG. 3.
Figure 7:
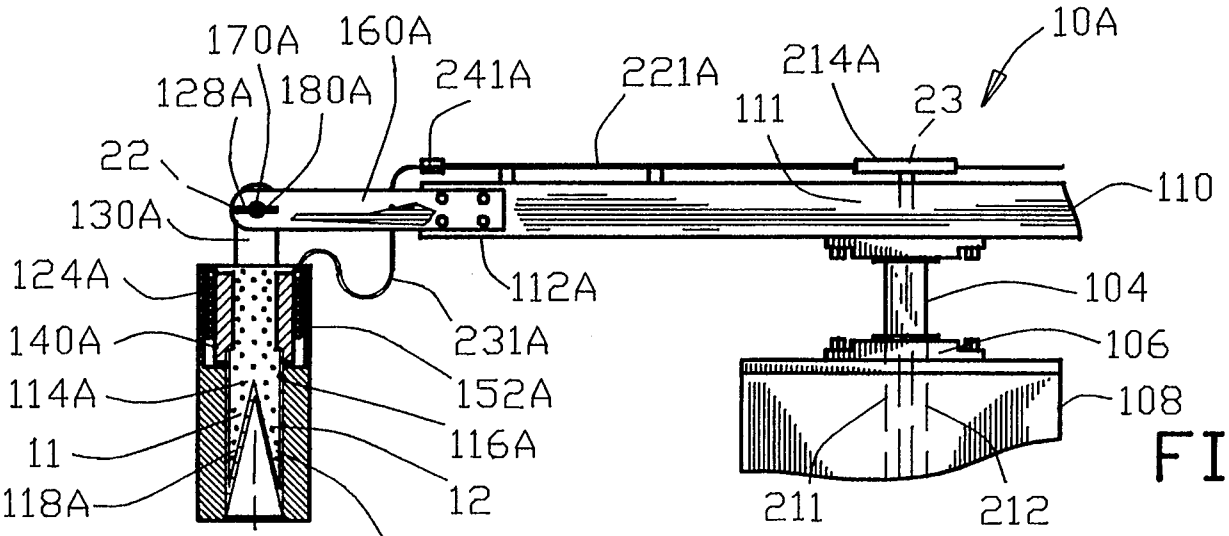
FIG. 7 is a partial enlarged side elevational view of the apparatus of FIG. 3 illustrating the mold cavity in section.

FIG. 3 is a side elevational view of an apparatus 10A for enhancing the concentration of the second material 12 within the first material 11 with the apparatus 10A being shown in a static condition. FIG. 4 is a top view of FIG. 3 whereas FIG. 7 is a partial enlarged side elevational view of the apparatus 10A of FIGS. 3 and 4 with the apparatus 10A being shown in the static condition.

The apparatus 10A comprises a base 102 for rotatably mounting a rotation member shaft 104 through a bearing 106 secured to a frame 108. A rotatable member 110 extends from a central region 111 to peripheral regions 112A and 112B with the central region 111 being secured to the rotational member shaft 104. The rotation member shaft 104 defines the third axis 23. In this embodiment, the rotatable member 110 is shown as a linear member, but it should be understood that the rotatable member 110 may be configured as a disk or the like.

Figure 8:
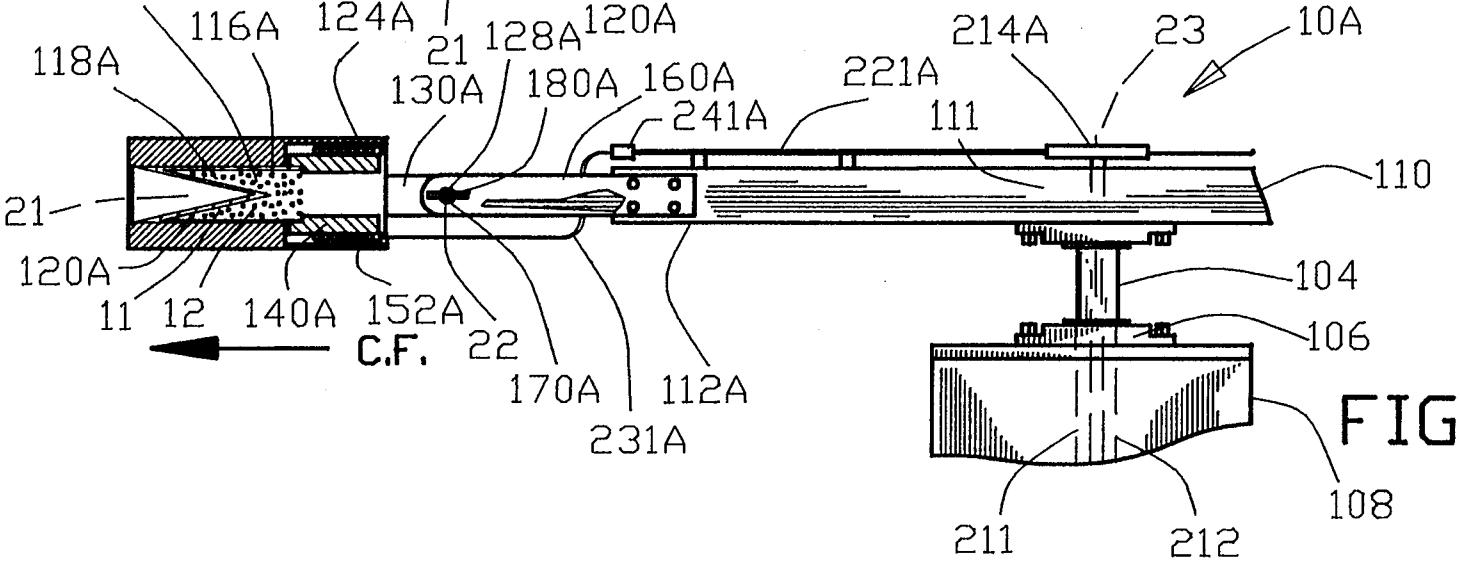
FIG. 8 is a partial enlarged side elevational view of the apparatus of FIG. 5 illustrating the mold cavity in section.

A first and a second mold cavity 114A and 114B having preselected geometric shapes 116A and 116B are defined by interiors 118A and 118B located within first and second container 120A and 120B. The first and second containers 120A and 120B are secured to the peripheral regions 112A and 112B of the rotational member 110. The first and second containers 120A and 120B are slidably received within first and second carriers 124A and 124B that are similar to the container carrier 24 shown in FIGS. 2A–2F. The first and second container carriers 124A and 124B have carrier arms 130A and 130B defining pivot apertures 128A and 128B. As best shown in FIGS. 7 and 8, a first and a second riser 140A and 140B having first and second heating coils 152A and 152B are secured to the first and second containers 120A and 120B as heretofore described.

A first and a second coupling 160A and 160B are secured to the peripheral regions 112A and 112B with the first and second couplings 160A and 160B defining first and second coupling apertures 170A and 170B. A first and a second locking pin 180A and 180B extend through the first and second coupling apertures 170A and 170B and the first and second pivot apertures 128A and 128B to pivotable support the first and second container carriers 124A and 124B from the peripheral regions 112A and 112B of the rotational member 110. The first and second locking pins 180A and 180B define the second axes 22 and 22.

The frame 108 supports a motor 190 which may be an air motor, a hydraulic motor, an electric motor or the like. The motor 190 is connected through a variable speed drive 196 for rotating the rotatable member shaft 104 at a desired rotational rate. A heat source 200 shown as a steam source includes an output connector 201 and a return connector 202. Although the heat source 200 has been shown as a steam source, it should be understood that various types of heat sources may be incorporated within the apparatus 10A. The output and return connectors 201 and 202 are connected through conduits 204 and 206 to a rotary coupling 210. An output conduit 211 and a return conduit 212 extend from the rotary coupling 210 through the rotatable member shaft 104 to an output and return manifold 214A and 214B.

A first and a second output conduit 221A and 221B and a first and a second return conduit 222A and 222B extend from the output and return manifolds 214A and 214B adjacent to the first and second couplings 160A and 160B. A first and a second output flexible conduit 231A and 231B are connected to the first and second output conduits 221A and 221B through a first and a second output fluid coupling 241A and 241B. In a similar manner, a first and a second return conduit 232A and 232B are connected to the first and second return conduits 222A and 222B through a first and a second return fluid coupling 242A and 242B. The first and second output flexible conduits 231A and 231B and the first and second return conduits 232A and 232B are connected to a first and a second heating coil 152A and 152B secured to the first and second risers 140A and 140B. Preferably, the first and second output fluid couplings 241A and 241B and the first and second return fluid couplings 242A and 242B are quick disconnect fluid couplings for facilitating the insertion and removal of the first and second risers 140A and 140B from the apparatus 10A.

FIG. 7 illustrates the apparatus 10A in the static condition with the first axis 21 of the mold cavity 114A extending through the axis of symmetry of the container 120A in a substantially vertical orientation for receiving the first and second materials 11 and 12 within the mold cavity 114A. The container 120A is pivotable upon the second axis 22 extending through the first pivot aperture 128A, the first coupling aperture 170A and the first locking pin 180A. The second axis 22 extends external to the container 120A and is disposed substantially perpendicular to the first axis 21. The container 120A is rotatable about the third axis 23 extending through the rotation member shaft 104. In the static position, the first axis 21 is substantially parallel to the third axis 23.

FIG. 8 illustrates the apparatus 10A in the rotating condition wherein the first and second containers 120A and 120B are rotated about the third axis 23 external to the first and second containers 120A and 120B for generating the centrifugal force as shown by the arrow to enhance the migration of the second material 12 through the first material 11. The third axis 23 extends external the first and second containers 120A and 120B through the rotatable member shaft 104 in a substantially vertical orientation. The third axis 23 is disposed substantially perpendicular to the second axis 22.

Upon the energizing of the motor 190, the variable speed drive 196 rotates the rotatable member shaft 104 at a desired rotational rate as determined by the variable speed drive 196. The rotatable member shaft 104 rotates the rotatable member 110 to generate the centrifugal force upon the first and second carriers 124A and 124B and the first and second containers 120A and 120B. The centrifugal force acting upon the first and second carriers 124A and 124B and the first and second containers 120A and 120B rotates the first and second carriers 124A and 124B and the first and second containers 120A and 120B upon the first and second locking pins 180A and 180B to the position as shown in FIGS. 5, 6 and 8.

Figure 5:
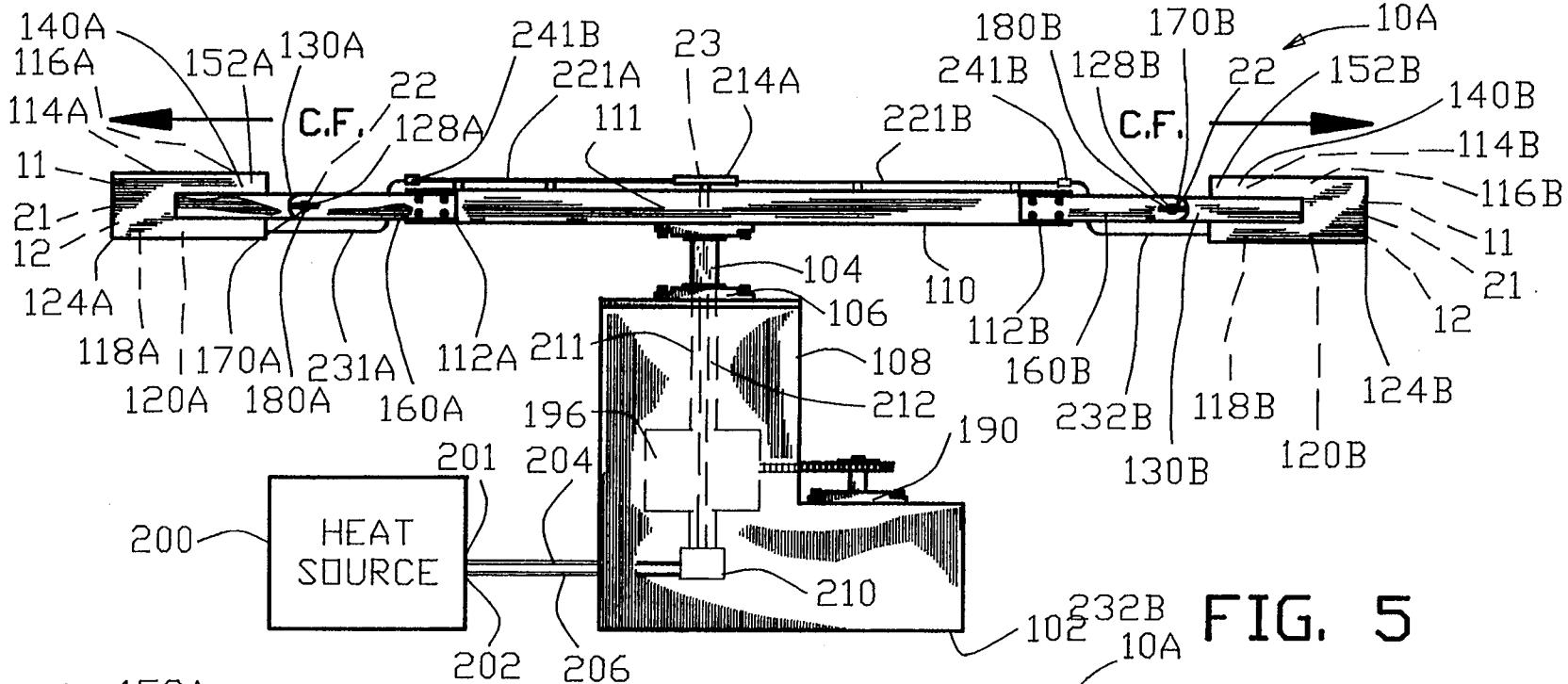
FIG. 5 is a side elevational view of the apparatus of FIG. 3 being shown in a rotating condition.
Figure 6:
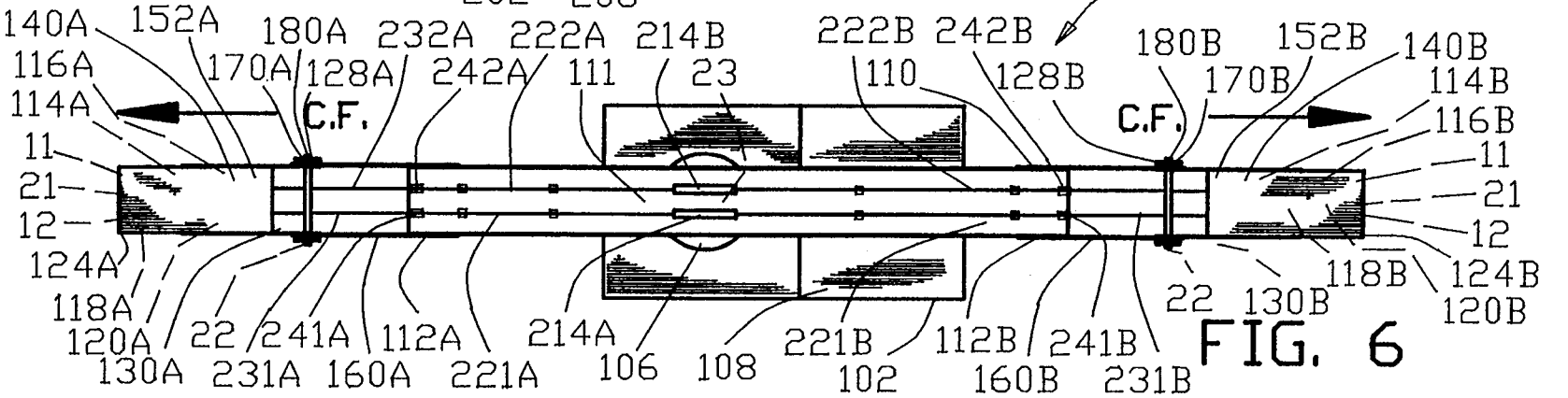
FIG. 6 is a top view of FIG. 5.

When the first and second carriers 124A and 124B rotate the first and second containers 120A and 120B to the position as shown in FIGS. 5, 6 and 8, the centrifugal force acts upon the first and second materials 11 and 12 within the mold cavities 114A and 114B. The centrifugal force acting upon the first and second materials 11 and 12 within the mold cavities 114A and 114B facilitates the migration of the second material 12 through the first material 11 to enhance the concentration of the second material 12 within the first material 11.

The method 10 and the apparatus 10A of the present invention has been found useful for enhancing the concentration of a large variety of first materials 11 with a large variety of second materials 12. In addition, the method 10 and the apparatus 10A of the present invention may be used with multiple first and second materials 11 and 12 as well as a second material 12 with a multiple particle size.

In one example, the method 10 and the apparatus 10A of the present invention has been found useful for enhancing the concentration of a first material 11 such as thermally reversible trinitrotoluene (TNT) with a solid particulate second material 12 such as cyclotrimethylenetrinitramine (RDX) or cyclotetramethylenetetranitramine (HMX). Thermally reversible trinitrotoluene (TNT) having a melting point of 165° F. may be used as the first material 11 whereas solid particulate RDX or HMX having a particle size of 1.0μ to 300μ may be used as the second material 12.

In this example, the TNT is heated to approximately 169°-220° F. by conventional means and the RDX or HMX is mixed with the TNT. After proper mixing, the mixture is placed within the mold cavity 114A of the first container 120A to a level to substantially fill the first riser 140A. The first container 120A and riser 140A is placed within the first container carrier 124A. The second container 120B is prepared in a similar manner. Steam from the steam source 200 is applied to the first and second heating coils 152A and 152B to continue heating the first and second materials 11 and 12.

The motor 190 is energized to rotate the rotatable member shaft 104 and the rotatable member 110. Preferably, the rotatable member shaft 104 is rotated at a rate of 100 to 200 revolutions per minute with the rotatable member 110 having a length of 2.5 feet to generate a centrifugal force upon the first and second containers 120A and 120B of 40 to 80 times the force of gravity (G). The rotatable member 110 is heated and rotated for a period of approximately 20 minutes.

After the period of heating and rotation, the heat from the heat source 200 to the first and second risers 140A and 140B is terminated and the rotatable member 110 is continued to be rotated while the first and second materials 11 and 12 cool within the mold cavities 114A and 114B. Typically, the first and second materials 11 and 12 will solidify within a period of 15 minutes. The rapid solidification of the first and second materials 11 and 12 is due in part to the cooling action caused by the continued rotation of the rotatable member 110. After solidification of the first and second materials 11 and 12, the mixture typically has a final concentration of 82% to 85% of RMX or DMX and 15% to 18% TNT.

In the prior art sedimentation casting process, the concentration of the second material 12 within the first material 11 using a conventional vibration process typically provides a final concentration of 82%. However, the prior art sedimentation casting process typically requires 6 to 8 hours of sedimentation and 3 days for cooling the mixture of the first and second materials 11 and 12.

In the prior art squeeze casting process, the concentration of the second material 12 within the first material 11 using a conventional squeeze casting process typically provides a final concentration of 85%. However, the prior art squeeze casting process typically requires 4 to 5 hours of squeezing and 1 day for cooling the mixture of the first and second materials 11 and 12.

The present method and apparatus of the present invention provides a concentration of the second material 12 within the first material 11 commensurate with the concentration achieved by the prior art sedimentation casting process and the prior art squeeze casting processes in a fraction of the time required by these prior art processes. In addition, the present method and apparatus produces a finer grain crystal growth than the prior art sedimentation casting process. Furthermore, the method and apparatus of the present invention produces a casting have less cracking of the first and second materials 11 and 12 than the prior art sedimentation process or the squeeze casting process.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An apparatus for enchancing the concentration of a second material within a first liquid material, comprising:

a base for rotatably mounting a rotation member shaft;

a rotatable member having a central region and a peripheral region with said central region being secured to said rotational member shaft for rotation therewith;

a container defining an opening with said container being secured to said peripheral region of said rotational member;

a riser located proximate to said opening in said container for enabling the introduction of the first and second materials into said container to at least partially fill said riser; and means for rotating said rotatable member shaft to generate a centrifugal force for facilitating the migration of the second material through the first material to enhance the concentration of the second material within the first material in said container relative to the concentration of the second material within the first material in said riser.

2. An apparatus for enhancing the concentration of a second material within a first liquid material as set forth in claim 1, wherein the second material is a solid particulate material.

3. An apparatus for enhancing the concentration of a second material within a first liquid material as set forth in claim 1, including heating means for heating said container and said riser during an initial period of rotation of said rotatable member to maintain the first material in a liquid state for enhancing the migration of the second material through the first material in said container.

4. An apparatus for enhancing the concentration of a second material within a first liquid material as set forth in claim 1, including cooling means for cooling said container and said riser during a final period of rotation of said rotatable member to solidify the first material with the enhanced concentration of the second material therein within said container.

5. An apparatus for enhancing the concentration of a second material within a first liquid material as set forth in claim 1, including a mold cavity having a preselected geometric shape defined within an interior of said container; and cooling means for cooling said container for solidifying the first material with the enhanced concentration of the second material therein into said preselected geometric shape defined within an interior of said container.

6. An apparatus for enhancing the concentration of a second material within a first liquid material as set forth in claim 1, wherein said rotational member shaft extends external to said container.

7. An apparatus for enhancing the concentration of a second material within a first liquid material as set forth in claim 1, wherein said container being secured to said peripheral region of said rotational member includes a pivot for pivotably mounting said container and said riser to said rotatable member; and said pivot having a pivot axis aligned generally perpendicular to said rotational member shaft for enabling said centrifugal force to pivot said container along said pivot axis upon rotation of said rotatable member.

8. An apparatus for enhancing the concentration of a second material within a first liquid material as set forth in claim 1, wherein said rotatable member shaft is disposed in a substantially vertical orientation.

9. An apparatus of forming a first material into a preselected geometric shape with an enhanced concentration of a second material within a first material, comprising:

a base for rotatably mounting a rotation member shaft;

said rotatable member shaft being disposed in a substantially vertical orientation;

a rotatable member having a central region and a peripheral region with said central region being secured to said rotational member shaft for rotation therewith;

a container defining an opening with said container communicating with a mold cavity of a preselected geometric shape defined within an interior of said container;

a riser located proximate to said opening in said container for enabling the introduction of the first and second materials to fill said mold cavity of said container to at least partially fill said riser;

a pivot pivotably securing said container to said peripheral region of said rotational member;

said pivot having a pivot axis aligned generally perpendicular to said rotational member shaft; and heating means for heating said container and said riser for maintaining the first material in a liquid state;

means for rotating said rotatable member shaft to generate a centrifugal force for enabling said centrifugal force to pivot said container along said pivot axis for facilitating the migration of the second material through the first material to enhance the concentration of the second material within the first material in said container relative to the concentration of the second material within the first material in said riser;

cooling means for cooling said container and said riser for solidifying the first material within said container and said riser with the enhanced concentration of the second material being located within said preselected geometric shape defined within said interior of said container relative to the concentration of the second material within said riser.

10. An apparatus for enhancing the concentration of a second material within a first liquid material as set forth in claim 9, wherein the second material is a solid particulate material.

11. An apparatus for enhancing the concentration of a second material within a first liquid material as set forth in claim 9, wherein said pivot enables said container and said riser to be disposed in a substantially vertical orientation for enabling the introduction of the first and second materials into said container and said riser and for enabling removal of said solidified first material and second material upon non-rotation of said rotatable member shaft; and said pivot enabling said container to be disposed in a substantially horizontal orientation for enabling the centrifugal force to facilitate the migration of the second material through the first material to enhance the concentration of the second material within the first material in said container upon rotation of said rotatable member shaft.

* * * * *